United States Patent [19]

Weiner

[11] Patent Number: 4,662,142

[45] Date of Patent: May 5, 1987

[54] MOUNTING DEVICE AND METHOD FOR MAKING A DYNAMICALLY STIFF JOINT

[76] Inventor: David Weiner, Ostra Allen 9, 181 62 Lidingo, Sweden

[21] Appl. No.: 559,174

[22] Filed: Dec. 7, 1983

[51] Int. Cl.[4] ..... E04B 1/68; E04B 1/98

[52] U.S. Cl. ..... 52/573; 52/167; 52/223 L; 52/292; 52/741; 248/638; 248/679

[58] Field of Search ..... 52/1, 169, 223 R, 223 L, 52/167, 292, 523, 126.4, 126.7, 741; 248/638, 636, 679

[56] References Cited

U.S. PATENT DOCUMENTS

| | | | |
|---|---|---|---|
| 3,110,464 | 11/1963 | Baratoff et al. | 52/167 |
| 3,425,652 | 2/1969 | Leary | 248/638 X |
| 3,755,980 | 9/1973 | Weidlinger | 52/573 X |
| 3,794,277 | 2/1974 | Smedley et al. | 52/167 |
| 3,940,895 | 3/1976 | Yamamoto et al. . | |
| 4,188,681 | 2/1980 | Tada et al. | 52/167 |
| 4,328,648 | 5/1982 | Kalpins | 248/638 X |
| 4,353,189 | 10/1982 | Thiersch | 52/167 |
| 4,371,143 | 2/1983 | Ishida et al. | 52/167 |
| 4,411,114 | 10/1983 | Wurtinger et al. | 52/223 R |
| 4,581,199 | 4/1986 | Bioret et al. | 52/167 X |

FOREIGN PATENT DOCUMENTS

| | | | |
|---|---|---|---|
| 922191 | 1/1947 | France | 52/573 |
| 565908 | 8/1975 | Switzerland . | |
| 584333 | 1/1977 | Switzerland . | |
| 1260281 | 1/1972 | United Kingdom . | |
| 881208 | 11/1981 | U.S.S.R. | 52/292 |

OTHER PUBLICATIONS

German Language Reference—Maschinenfundamente.
General Electric—Oct. 1966—Steam Turbine-Generator Foundations.
German Industry Standard Publication DIN4024—Jan. 1955.

*Primary Examiner*—Alfred C. Perham
*Attorney, Agent, or Firm*—Lewis H. Eslinger

[57] ABSTRACT

A mounting device provides a dynamically stiff joint between two structural members, such as a machine foundation and a building structure. One of the structural members is subject to dynamic forces acting in a predetermined direction and the other is substantially static. The mounting device comprises a spanning element compressed between the structural elements to transmit dynamic forces between the structural elements in the predetermined direction and thereby restrict relative movement of the structural members. Movement-transmitting means, such as a ball joint, permits movement between the structural elements in all other directions. The spanning element is prestressed to provide a static force between the structural elements along the direction of the dynamic forces.

18 Claims, 12 Drawing Figures

Fig. 1
PRIOR ART
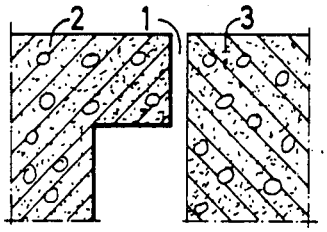
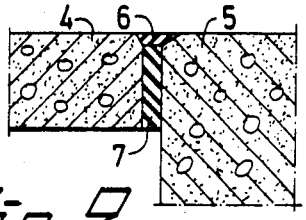
Fig. 2 PRIOR ART
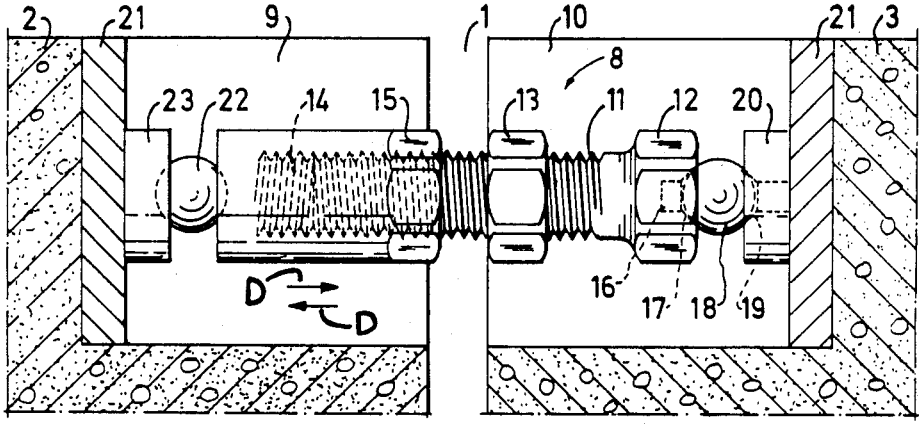
Fig. 3
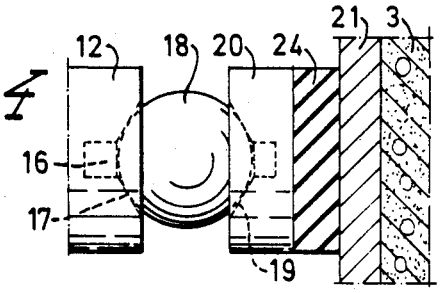
Fig. 4
Fig. 7
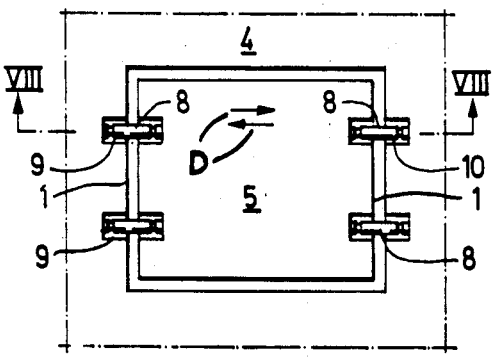
Fig. 8
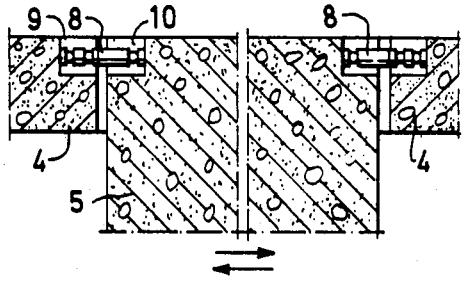

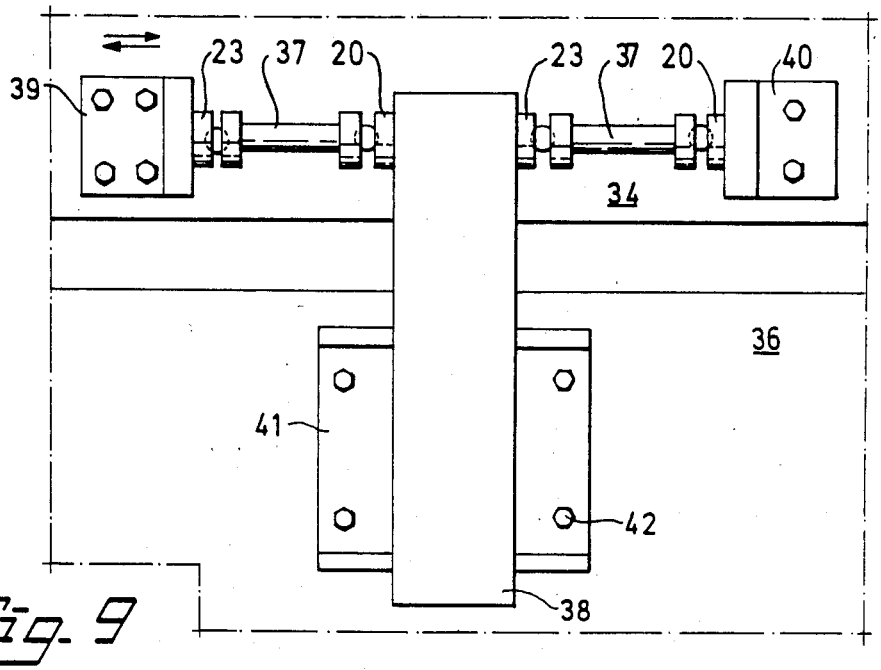
Fig. 9
Fig. 11
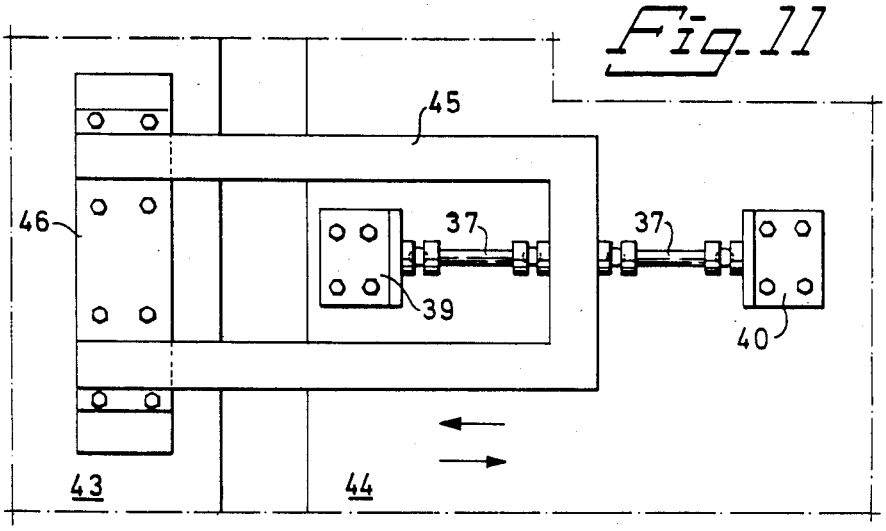
Fig. 12
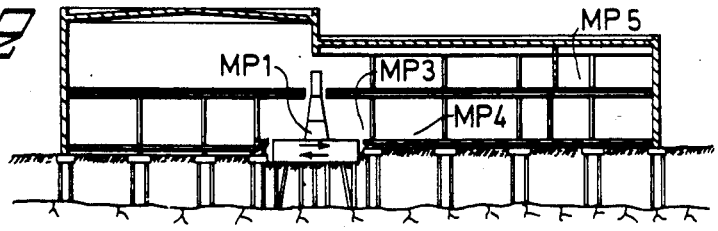

MOUNTING DEVICE AND METHOD FOR MAKING A DYNAMICALLY STIFF JOINT

BACKGROUND OF THE INVENTION

1. Field of the Invention

The present invention relates to a mounting device and method and, more particularly, mounting arrangements for apparatus subject to dynamic forces.

2. Description of the Prior Art

An expansion or movement joint generally comprises an air gap between two building codes units. The gap permits relative movement between the building units to avoid damage to the building made up of the building units when the building units move relative to each other. Such movement can result from, for example, temperature variations, expansion, shrinking or settling of the ground. The expansion joint can be covered or filled with a resilient material if desired.

One application of such expansion joints is between block foundations, which are embedded in the ground, and the surrounding building parts, such as concrete floors, columns or walls. Another is between the structure supporting a machine which develops large dynamic forces and the floor surrounding the machine. Such an expansion joint both avoids detrimental movements of the floor structure due to movements of the machine and prevents the spread of vibrations from the machine to adjacent building. An expansion joint for this purpose can also be filled or covered with resilient material. Typically, such a joint is an air gap 2–5 centimeters wide around the machine foundation.

The provision of expansion joints around the foundations of machines which develop large dynamic forces is recommended by leading experts. See E. Rausch, "Maschinenfundamente und Andere Dynamisch Beanspruchte Baukonstruktionen", VDI-Verlag GmbH, Dusseldorf 1959; D.D. Barkan, "Dynamics of Bases and Foundations", p. 133, 245,McGraw-Hill Book Co.; and P. Srinivasulu and C.V. Vaidyanathan, "Handbook of Machine Foundations", p. 74, 136, 213, McGraw-Hill Book Co., NY 1978. In addition many countries have building that require expansion joints around machine foundations.

Recent technical developments have resulted in stronger machines, while buildings are becoming less sturdy because the higher-quality building materials being used have less dynamic stiffness and provide reduced damping. Moreover, there is a tendency towards larger and larger industrial plants and increasingly close positioning of machinery. These developments have contributed to an increase of the number of cases of structural damage due to vibration. It has even been found that, in extreme cases, prior art expansion joints have had an effect directly contrary to the desired one, by actually contributing to an increase of the vibration levels in the adjacent, statically loaded, parts of the building housing the machinery.

SUMMARY OF THE INVENTION

It is an object of the present invention to overcome the shortcomings and disadvantages of prior art mounting devices.

It is another object of the present invention to provide a mounting device which increases the dynamic stiffness of a structural member subject to dynamic loading.

It is a further object of the present invention to provide a method for increasing the dynamic stiffness of a machine foundation subject to dynamic forces.

In accordance with an aspect of the present invention, the dynamic stiffness of a first structural member, which is subject to dynamic forces acting along a predetermined direction, generally horizontal relative to a substantially static second structural member is increased by transmitting the dynamic forces between the members in the predetermined direction to restrict the relative movement of the members. The structural members are also interconnected in a way which permits relative movement in all directions but the predetermined direction and a static prestressing force is provided between the structural members in the predetermined direction.

The above and other objects, features and advantages of the present invention will be clear upon consideration of the detailed description of preferred embodiments which follows.

BRIEF DESCRIPTION OF THE DRAWINGS

FIGS. 1 and 2 show sectional views of different embodiments of prior art expansion joints.

FIG. 3 is a side elevation, partly in section, of a first embodiment of a mounting device in accordance with the present invention.

FIG. 4 is a side elevation, partly in section, of a modified embodiment of the mounting device shown in FIG. 3.

FIG. 7 is a plan view of a building provided with a mounting arrangement in accordance with the present invention.

FIG. 8 is a sectional view taken along line VIII—VIII in FIG. 7.

FIG. 9 is a plan view of an alternate embodiment of a mounting arrangement in accordance with the present invention.

FIG. 11 is a plan view of another embodiment of a mounting arrangement in accordance with the present invention.

FIG. 12 is a side-elevation view of an industrial plant in which tests have been performed using the present invention.

DETAILED DESCRIPTION OF PREFERRED EMBODIMENTS

Figure 5:
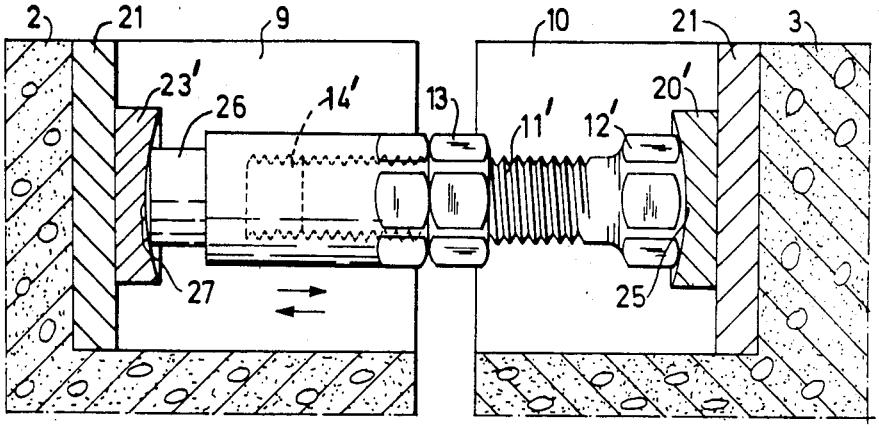
FIG. 5 shows another embodiment of the mounting device shown in 3.

FIG. 1 is a cross-sectional view of a prior art expansion joint 1 provided between two building units 2 and 3. The expansion joint 1 is an air-gap 2–5 centimetres wide. FIG. 2 shows a prior art expansion joint between a floor structure 4 and a machine-supporting foundation 5. This expansion joint is filled in a conventional manner with mastic 6 and resilient filler 7.

Such conventional expansion joints are filled with compressible, elastic, nonextruding material, which is intended to accommodate the relative movement between the adjacent structural elements, and at the same time to provide an adequate seal against water and foreign matter. However, no single material has been found yet which will completely satisfy those conditions. Essentially three types of materials have been used: joint fillers (such as strips of asphalt-impregnated fiberboard), sealers, and waterstops; sealers (sealing compounds) and waterstops (rubber, plastic, or metal) typically have been used where a joint has to be sealed against the passage of water, sometimes under pressure.

The mounting device 8 according to the present invention is shown generally in FIG. 3. The device 8 can be used in an existing expansion joint, like the expansion joint 1, if two compartments or boxes 9 and 10 are hewn or otherwise provided in the building units 2 and 3 in mutually opposite positions on either side of the expansion joint 1. New buildings can be provided with the compartments 9 and 10 by properly molding the building units 2 and 3 during construction of the building.

The mounting device 8 comprises spanning element, which as shown in FIG. 3 comprises a bolt 11 having a head 12. A stop-nut or locknut 13 is screwed onto the bolt 11. The bolt 11 is threaded into a sleeve 14 having an internal thread. The sleeve 14 is provided with a wrenching surface or gripping means 15 corresponding to similar means on the bolt head 12 and on the stop-nut 13. The bolt 11 and the sleeve 14 together form a stiff, adjustable-length member which transmits forces between the building units 2 and 3. A blind hole 16 is provided centrally in the bolt head 12. The edge of the blind hole 16 is bevelled to form an oblique surface which comprises a seat 17 for a ball 18. A corresponding bevelled seat 19 is formed in a block 20 which is firmly anchored, for example by welding, to a support plate 21 that abuts the end wall of the compartment 10. If the end wall is flat and hard, the support plate 21 may be omitted. The block 20 can then be directly molded into the end wall or attached thereto in any other suitable manner. The movement-transmitting means 17–20 interconnects the building unit 3 and the spanning element to permit their relative movement in all directions except along the axis of the spanning element. A corresponding movement-transmitting means 21–23 is provided at the opposite end of the spanning element. It comprises a ball 22, a seat (not shown) for the ball 22 in the end surface of the sleeve 14 and a block 23 provided with a seat (not shown) for the ball 22. The block 23 is mounted to another support plate 21 like that mounting the block 20. The adjustable-length spanning element thus forms a force-transmitting means for transmitting dynamic forces between the building units 2 and 3. In the embodiment in FIG. 3 the main component of the dynamic forces (ordinarily due to vibration) are presumed to act in the predetermined directions indicated by the arrows D, that is, in the axial direction of the spanning element.

To maintain a stiff connection between the building units 2 and 3 in the direction of the dynamic forces, the force-transmitting means is prestressed by using the adjustable-length feature of the spanning element. The building units 2 and 3 are presumed to be statically unyielding and the spanning element is provided with a compression force which is greater than the dynamic forces acting in the predetermined direction. Preferably the static force is at least twice the maximum dynamic force acting in the predetermined direction, as is described in more detail below. Force thus is transmitted only in the predetermined direction of the dynamic forces, while the building units 2 and 3 are permitted to move in relation to each other in all other directions.

The magnitude of the static force applied by the spanning element is adjusted by applying an adjustable wrench over the gripping means 15 of the sleeve, that wrench being held stationarily while a torque wrench (known per se) is used to turn the bolt in relation to the sleeve until the desired axial force is achieved. Then, the position of the sleeve 14 relative to the bolt 12 is fixed by tightening the stop-nut 13 against the sleeve 14. The size of the prestressing force may be monitored with the aid of known devices applied, for example, to the threaded portion of the bolt.

FIG. 4 shows an alternative embodiment of the mounting device shown in FIG. 3. The device in FIG. 4 corresponds generally to the device shown in FIG. 3, except that a disc 24 of resilient material is inserted between the block 20 and the support plate 21. A resilient disc can also be placed between the block 23 and its corresponding support plate 21. The resilient disc 24 tends to damp the dynamic forces acting in the predetermined direction. If the support plate 21 is omitted, the disc 24 is placed between the wall of the compartment 10 (or 9) and the block 20 (or 23). The embodiment according to FIG. 4 is of particular utility when the mounting device is used in expansion joints in connection with building units which may be subjected to large shocks in addition to vibratory dynamic forces.

FIG. 5 shows an embodiment of a mounting device in which the movement-transmitting means is changed from that used with the device previously described. The adjustable-length spanning element is similar to that shown in FIG. 3, and the same reference designations for mutually corresponding elements have been used in FIG. 5. The movement-transmitting means at the head, 12' of the bolt 11', in the embodiment in FIG. 5, is a spherically ground surface 25 abutting against a correspondingly shaped spherical surface on the block 20'. A nose 26 is welded to the end of the sleeve 14' as shown in FIG. 5 and a spherical surface 27 is ground on the end surface of the nose 26. A corresponding spherical surface is ground into the end surface of the block 23'. Alternatively, the spherical surface 27 may be ground directly in the end surface of sleeve the 14' without using the nose 26. Or, a nose could be used to provide the spherical surface 25 at the bolt head 12. In the embodiment of FIG. 5 an elastic disc corresponding to the disc 24 between the block 20 or 23 and the support plate 21 could be employed as shown in FIG. 4.

Figure 6:
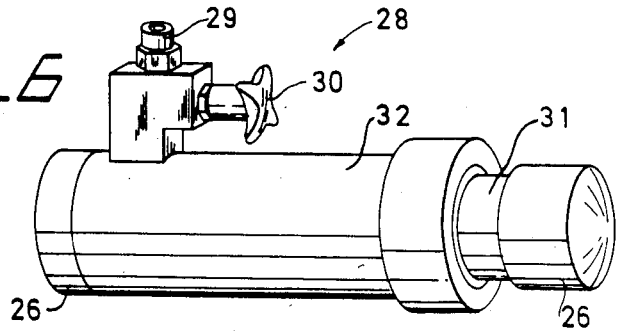
FIG. 6 illustrates an alternate embodiment of a force-transmitting element comprising the mounting device shown in FIG. 5.

In FIG. 6 there is shown another embodiment of a stiff, adjustable-length spanning element comprising a hydraulic unit 28 of a known type, such as the hydraulic unit offered for sale by the Swedish firm of Bahco under the type designation CX 100-100. A nipple 29 is provided for connecting the hydraulic cylinder to a pressure source. By means of a handle 30, valve is opened when the pressure source has been connected to nipple 29 to cause the piston 31 and the hydraulic cylinder 32 to move in relation to each other. The valve is closed when the desired degree of expansion has been obtained. The connection to the pressure source at the nipple 29 may then be detached. Both end faces of the piston 31 and the cylinder 32 are provided with movement-transmitting means of the type shown in FIG. 5, that is, a nose 26 having a spherical ground surface adapted to cooperate with corresponding spherical surfaces ground in blocks 20 and 23 as shown in FIG. 5. As an alternative to the spherical surface blocks 26 in FIG. 6, the ends of the piston and cylinder may be provided with seating arrangements like those shown in FIG. 3, in which case the movement transmitting means shown in FIG. 3 would also be used. Also in the embodiment according to FIG. 6 a resilient disc 24 could be provided between the blocks 20, 23 and support plates 21 as shown in FIG. 4.

FIGS. 7 and 8 show a building incorporating a mounting arrangement using the mounting device according to any of the above described embodiments, in connection with a machine foundation 5 surrounded by a floor structure 4. Between these two building units 4 and 5 a continuous expansion joint is provided. The floor structure 4 is presumed to be sufficiently strong to sustain the dynamic forces in the predetermined direction along the arrows D. The number of mounting devices, as well as their positioning, is shown in FIG. 7, but generally that number depends on the particular conditions prevailing on the site. As a general rule the mounting devices are to be positioned in symmetrical pairs along the predetermined direction in order to avoid a rotary moment from being produced. Each mounting device is inserted in the compartments or boxes 9 and 10 below the surface of the floor structure and the machine foundation, as shown in FIG. 8. The boxes are then covered with a loose protective plate (not shown).

It will be apparent to those skilled in the art that in the embodiment shown in FIG. 7, where the mounting devices are substantially the same, that the static force due to prestressing the mounting devices should be at least twice the opposing dynamic forces which the devices are to be subject to. Otherwise, a rigid connection will not be maintained by the mounting devices at all times.

Figure 10:
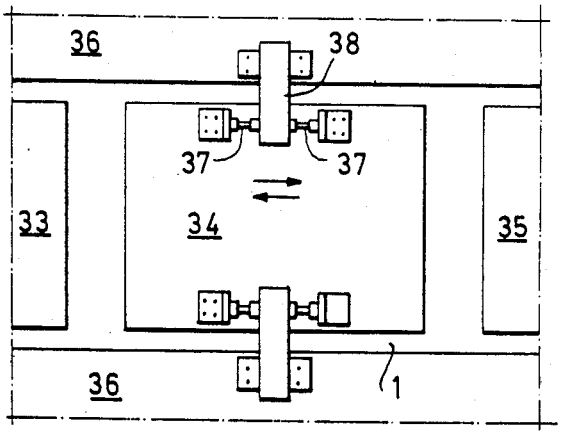
FIG. 10 is a plan view a building provided with the mounting arrangement shown in FIG. 9.

FIGS. 9 and 10 illustrate another embodiment of the mounting arrangement according to the present invention. This embodiment of the invention is intended to be used when the building unit in the predetermined direction is not sufficiently strong to support the dynamic forces or when there is no building unit situated in this direction. The mounting arrangement for this type of building is shown most clearly in FIG. 10, which depicts three aligned machine foundations 33, 34 and 35. A floor structure 36 lies along two opposite sides of the machine foundations. The dynamic forces, of course, must be transferred to the floor structure 36. The mounting arrangement shown in FIG. 9 comprises the following main components: Two mounting devices 37 of the type described above in connection with FIGS. 3–6, a leg 38 for transferring the dynamic forces between the machine foundation 34 and the floor structure 36 and brackets 39, 40 and 41. A main bracket 41 comprises a channel beam which, by means of bolts 42 or other anchoring means, is attached to the floor structure 36. The leg 38 is welded to the upper side of the legs of the channel beam as shown in FIG. 9 and extends over the machine foundation 34. L-shaped holding brackets 39 and 40 are positioned on opposite sides of the end of the leg 38 extending over the machine foundation 34. The brackets 39 and 40 are rigidly anchored to the machine foundation 34. In each of the spaces between the upstanding legs of the brackets 39 and 40 and the opposite sides of the leg 38, one mounting device 37 is inserted in a manner as described above in connection with FIGS. 3–6. Each mounting device 37 is prestressed to provide a static force of a magnitude in accordance with the principles previously described.

Thus an expansion joint is formed which transmits dynamic forces in one direction, namely, the "main" direction, that is, the directions indicated by the arrows in FIGS. 9 and 10, which are assumed to represent the to-and-fro movements of the machine foundations 33–35 under the action of rotating masses, gear-wheel play or the like in the machines mounted on the machine foundations. The movement-transmitting means of the mounting devices 37 permit movement of the building units 34 and 36 relative to each other in all other directions. The mounting arrangement shown in FIGS. 9 and 10 may be mounted beneath the level of the floor of the building units and covered with plates to avoid hazards to workers using the area.

FIG. 11 shows another embodiment of a mounting arrangement according to the present invention. The mounting arrangement according to this embodiment is similar to that described in connection with FIG. 9, except that the leg for transmitting dynamic forces between the machine and the building here comprises a U-shaped yoke 45 the sides of which are firmly anchored in a main bracket 46 carried by a building structure 43. On either side of the bight of the yoke, and in mutually opposite positions, the holding brackets 39 and 40 are firmly anchored to a machine foundation 44. Between each holding bracket 39 and 40 and opposite sides of the bight of the yoke, a mounting device 37 is inserted. In this embodiment of the invention it is preferred that resilient discs 24 as described in connection with FIG. 4 be provided between the holding brackets or the web of the yoke and the mounting devices to damp shock forces. As in the embodiments described above, the mounting devices 37 increase the dynamic stiffness of the building construction. The movement-transmitting elements in the force-transmitting device stiffly connect the building units 43 and 44 with each other in the direction of the dynamic forces, as indicated by the arrows in FIG. 11, while permitting relative movement between the units in all other directions.

The present invention has actually been tested in a saw mill the basic construction of which is shown in FIG. 12. The saw house has a surface of 2500 square meters and is supported by piles driven to solid ground. Four foundations, supporting a gang saw, are lowered 2.5 meters below the floor surface and contain about 100 cubic meters of concrete each. Each of those foundations is supported by concrete piles driven to solid ground. A total of twenty-two piles is provided. Between the floor and the foundations of the gang saw and exapnsion joint like that shown in FIG. 7, having a width of 2 centimeters, is provided. Velocity transducers (so-called Geophones) are provided at measuring points MP1, MP3, MP4 and MP5 to perform measurements of the velocity magnitudes (in mm/sec) prior to and after using the mounting arrangement in accordance with the present invention. The actual mounting devices were like those shown in FIG. 3. The results of the measurements will appear from Table I where the direction x refers to a direction parallel to the sawing direction (that is, in the direction of the dynamic force), whereas y refers to the horizontal direction perpendicular thereto and z is the vertical direction.

TABLE I

| | | Velocity magnitude V in mm/sec | |
|---|---|---|---|
| Measuring Point | Measuring direction | Without force-transmitting element | with force-transmitting element |
| MP1 | x | 37.9 | 5.7 |
| (Gang saw foundation 3) | y | 1.7 | 0.3 |
| | z | 2.4 | 2.0 |

TABLE I-continued

| Measuring Point | Measuring direction | Velocity magnitude V in mm/sec: Without force-transmitting element | Velocity magnitude V in mm/sec: with force-transmitting element |
|---|---|---|---|
| MP2 | x | 6.5 | 1.1 |
| (Gang saw foundation 2) | y | 2.0 | 1.1 |
| MP3 | x | 1.5 | 0.5 |
| (Adjacent structure) | z | 1.5 | 0.5 |
| MP4 | x | 2.7 | 0.5 |
| (Adjacent structure) | z | 2.0 | 0.3 |
| MP5 | x | 1.8 | 0.6 |
| (Office) | x | 1.8 | 0.6 |

Table I shows that the dynamic stiffness of the machine foundation in the horizontal direction increases, which means that the surface area or volume or both of the machine foundations in question may be reduced as desired and the number of supporting piles thus also may be reduced. The natural frequencies of the machine foundation and adjacent building construction in this saw mill example fall outside the resonant range both prior to and after application of the mounting devices.

Those skilled in the art will thus recognize that rigidly connecting structural units with the mounting device of the present invention can increase the dynamic stiffness of an entire building. The mounting device transmits forces in the major direction of the dynamic forces while permitting movement between the structural elements in all other directions. Pre-stressing the device maintains rigidity of the joint under the dynamic loading. Of course, the force-transmitting means of the present invention can be made in many different configurations. For example, it could be a turnbuckle or a pneumatic device as well as the embodiments described herein. The magnitude of the prestressing force can also be continuously mentioned by using known recording devices.

Although the present invention has been described in connection with several embodiments, it will be appreciated that many modifications, other than those specifically mentioned, can be made without departing from the spirit of the invention. For that reason, the scope of the present invention is limited solely by the claims that follow.

What is claimed is:

1. a mounting device for increasing the dynamic stiffness of a first structural member, which is subject to dynamic forces acting in two alternating directions along a horizontal line, relative to a substantially static second structural member separated from the first structural member by an unfilled gap, the device comprising:

stiff, force-transmitting means adapted to be inserted in said gap for transmitting along said horizontal line the dynamic forces in said two alternating directions between the structural members to restrict relative movement of the structural members;

movement-transmitting means provided at each end of said force-transmitting means for interconnecting said force-transmitting means and the structural members to permit relative movement of the structural members in directions other than along said horizontal line; and stressing means for prestressing said force-transmitting means to provide a static force between the structural members along said horizontal line, said static force being at least twice as great as the dynamic forces.

2. A device as in claim 1; wherein said force-transmitted means comprises a substantially straight, adjustable-length spanning element, said spanning element being adapted to extend between the structural elements along a horizontal line with said movement-transmitting means interposed between the ends of said spanning element and the respective structural elements, and said stressing means comprises means for adjusting the length of said spanning element.

3. A device as in claim 2; wherein said stressing means is adapted to place said spanning element in compression between the structural members.

4. A device as in claim 3; wherein said spanning element comprises a bolt and a threaded sleeve accepting said bolt.

5. A device as in claim 4; wherein said stressing means comprises wrenching surfaces on said bolt and said sleeve.

6. A device as in claim 5; further comprising a locknut threaded on said bolt for tightening against said sleeve to prevent relative rotation of said bolt and said sleeve.

7. A device as in claim 3; wherein said spanning element comprises a hydraulic cylinder and piston.

8. A device as in claim 7; wherein said stressing means comprises means for adjusting the hydraulic pressure in said cylinder.

9. A device as in claim 3; wherein said movement-transmitting means comprises a substantially spherical surface at the ends of said spanning element for cooperating with complementary surfaces on the respective structural members.

10. A device as in claim 3; wherein said movement-transmitting means comprises balls fitting in sockets at the ends of said spanning element and in sockets on the respective structural members.

11. A mounting arrangement for increasing the dynamic stiffness of a building having mounted thereto apparatus subject to dynamic forces acting along a predetermined direction relative to the building, the arrangement comprising a pair of mounting devices, each of which includes:

force-transmitting means for transmitting the dynamic forces between the apparatus and the building along the predetermined direction to restrict relative movement of the structural members including a substantially straight, adjustable-length, spanning element disposed on opposite sides of the apparatus and extending between the building and the apparatus along a line in the horizontal direction;

movement-transmitting means interposed between the ends of the spanning elements and the apparatus building to permit relative movement between the apparatus and building in direction other than along the horizontal direction; and stressing means for providing a static force between the apparatus and the building along the horizontal direction and including means for adjusting the length of said spanning elements to place said spanning elements in compression between the building and the apparatus, wherein both of said mounting devices are substantially identical and said static forces provided by said stressing means are at least twice as great as the dynamic forces acting on the apparatus.

12. A mounting arrangement as in claim 11; further comprising two said pairs of said devices.

13. A mounting arrangement as in claim 12; further comprising two mounting legs, each having one end thereof rigidly secured to the building and at the other end thereof having each said pair of said devices disposed in mutually opposing relationship spanning said leg and the apparatus, wherein said legs are normal to the predetermined direction.

14. A mounting arrangement as in claim 12; further comprising two mounting yokes, each having two legs secured at their ends to the building and having a bight portion contacting said legs and being contacted on mutually opposing faces by said ends of said spanning elements, wherein said bight portions are normal to the predetermined direction.

15. A mounting arrangement as in claim 11; wherein said movement-transmitting means comprises a substantially spherical means at the ends of said spanning elements and complimentary surfaces on said building and apparatus accepting said spherical means.

16. A mounting arrangement as in claim 11; further comprising support plates secured to the building and the apparatus and disposed between the building and the apparatus and the respective movement-transmitting means.

17. A mounting arrangement as in claim 11; further comprising damping means interposed between said movement-transmitting means and the building or the apparatus or both.

18. A mounting method for increasing the dynamic stiffness of a machine foundation subject to dynamic forces acting in two alternating directions along a horizontal line relative to adjacent substantially static building structure, the method comprising:

transmitting the dynamic forces between the machine foundation and the building structure in said two alternating direction along the horizontal line to restrict relative movement of the structural members;

permitting relative movement between the machine foundation and the building structure in directions other than along the horizontal line; and providing a static prestressing force between the machine foundation and the building structure along the horizontal line and in amount that is at least twice as great as the dynamic forces.

* * * * *